US005264861A

United States Patent [19]

Roederer et al.

[11] Patent Number: 5,264,861

[45] Date of Patent: Nov. 23, 1993

[54] CIRCULAR POLARIZATION ANTENNA

[75] Inventors: Antoine Roederer, Noordwijk, Netherlands; Pablo L. Garcia Mueller, Madrid, Spain; Anton W. Jongejans, Wassenaar, Netherlands

[73] Assignee: Agence Spatiale Europeene, Paris, France

[21] Appl. No.: 879,311

[22] Filed: May 7, 1992

[30] Foreign Application Priority Data

May 7, 1991 [FR] France ..... 91 05569

[51] Int. Cl.[5] ..... H01Q 9/38; H01Q 21/26

[52] U.S. Cl. ..... 343/828; 343/830; 343/846

[58] Field of Search ..... 343/729, 828–830, 343/846, 895, 899

[56] References Cited

U.S. PATENT DOCUMENTS 5,173,715 12/1992 Rodal et al. ..... 343/797

FOREIGN PATENT DOCUMENTS 861721 1/1953 Fed. Rep. of Germany .
1958108 5/1971 Fed. Rep. of Germany .
2824686 12/1979 Fed. Rep. of Germany ..... 343/797
2644937 9/1990 France .
107610 7/1982 Japan ..... 343/700 MS
2152757 8/1985 United Kingdom ..... 343/700 MS

*Primary Examiner*—Michael C. Wimer
*Attorney, Agent, or Firm*—Sughrue, Mion, Zinn, Macpeak & Seas

[57] ABSTRACT

A circular polarization antenna whose radiation pattern is in the shape of a body of revolution about an axis and has a radiation minimum in the direction of this axis comprises a reflective conductive surface which is essentially in the shape of a body of revolution about the axis. A rectilinear conductive rod extends axially from a first end at the level of and isolated from the conductive surface to a second end and is connected at its first end to an excitation line. A plurality of radiating arms each have a first part extending in an essentially radial plane from the second end of the conductive rod. This first part is electrically connected at its proximal end direct to the conductive rod and is extended at its distal end by a curvilinear rod typically lying on the surface of a sphere centered at the second end and whose general direction is inclined relative to the radial plane.

9 Claims, 1 Drawing Sheet

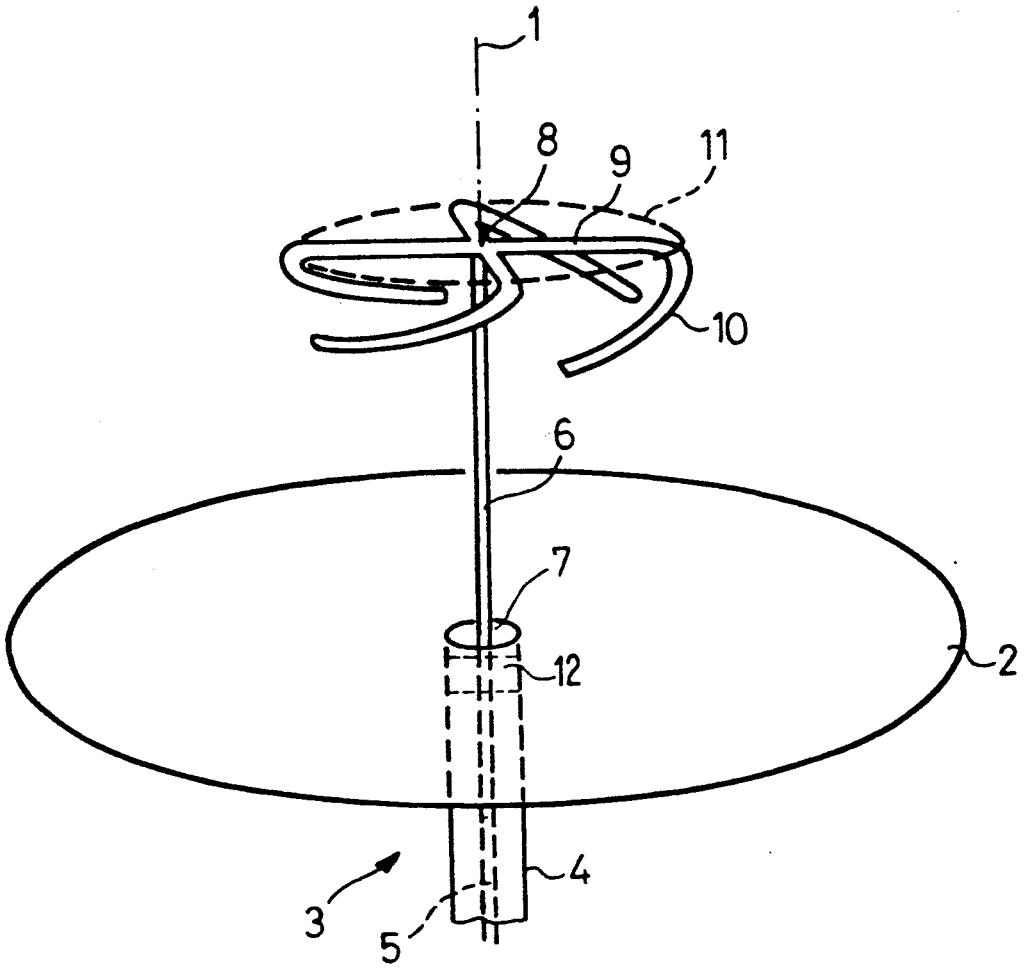
1
8
9
11
10
6
7
12
2
4
3
5

CIRCULAR POLARIZATION ANTENNA

BACKGROUND OF THE INVENTION

1. Field of the Invention

The present invention concerns a circular polarization antenna whose radiation pattern is in the shape of a body of revolution about an axis and has a radiation minimum in the direction of this axis.

2. Description of the Prior Art

Antennas of this type are usually implemented as a configuration of multirod conductors disposed in a tourniquet around the axis of the antenna, each rod being excited separately by a line from a distributor.

Such antennas are described, for example, by N.T. Lindeblad in Antennas and Transmission Lines at the Empire State Building Television Station, RCA Communications, Apr. 1941 (in which disclosure four dipoles are excited in phase separately, each by its own line), by M. S. Gatti and D. J. Nybakken in A Circularly Polarized Crossed Drooping Dipole Antenna, IEEE Antennas and Propagation Symposium Digest, 7-11 May 1990, Vol. 1, pp. 254-257, and by C. C. Kilgus in Shaped-Conical Radiation Pattern Performance of the Backfire Quadriflar helix, IEEE Transactions on Antennas and Propagation, May 1975 (in which disclosure four rods are excited by a power splitter and phase shifter system with respective phases of 0, 90, 180 and 270°).

Antennas of this type are routinely used on satellites for telemetry and remote control links, for example, and on land and maritime mobiles, in particular for satellite communication and location systems.

Antennas of the aforementioned type can also be implemented in the form of slotted printed circuit antennas, but these require a complex matching circuit.

The principal drawbacks of these various prior art antennas are their complexity, their relative fragility and the high cost of the excitation system which is typically a four-channel system requiring the provision of power splitter, phase shifter and balancer devices.

One object of the present invention is to propose an antenna of the aforementioned type, that is to say a circular polarization antenna having a radiation pattern which is in the shape of a body of revolution about an axis with a radiation minimum on said axis (a more or less toroidal shape pattern, for example) but with a much simpler structure and a direct excitation system requiring no power splitter, phase shifter or balancer devices.

A subsidiary object of the present invention is to propose an antenna of this type in which the maximum radiation direction can be varied by a simple choice of parameters so that the same basic structure can without difficultly yield an entire family of antennas suited to the various applications envisaged.

SUMMARY OF THE INVENTION

The invention consists in a circular polarization antenna whose radiation pattern is in the shape of a body of revolution about an axis and has a radiation minimum in the direction of said axis, comprising: a reflective conductive surface which is essentially in the shape of a body of revolution about said axis, a rectilinear conductive rod extending axially from a first end at the level of and isolated from said conductive surface to a second end and connected at its first end to an excitation line, and a plurality of radiating arms each having a first part extending in a essentially radial plane from the second end of said conductive rod, said first part being electrically connected at its proximal end direct to said conductive rod and extended at its distal end by a curvilinear rod typically lying on the surface of a sphere centered at said second end and whose general direction is inclined relative to said radial plane.

BRIEF DESCRIPTION OF THE DRAWING

One embodiment of the invention will now be described with reference to the appended single figure which is a perspective view showing the general configuration of this antenna in accordance with the invention.

DETAILED DESCRIPTION OF THE INVENTION

Referring to the figure, this antenna in accordance with the invention is generally symmetrical about an axis 1 which is the axis of revolution of the radiation pattern and also the minimum radiation direction for that pattern (in what follows this axis will be assumed to be "vertical" but this is naturally for convenience of description only, this feature being entirely relative and being without prejudice to the absolute spatial orientation of the antenna).

This axis is also the axis of symmetry of a generally horizontal conductive surface 2 whose electrical function is to provide a "ground plane," although this terminology must not be regarded as limiting on the invention; this surface can be various shapes, in particular:

it may be planar or non-planar, it may be a continuous surface or a mesh (with a mesh size in the order of 0.2 λ or less), its contour may be circular or polygonal.

The only constraints in respect of this reflective surface are that it must be electrically conductive (to function as a reflector) and essentially in the shape of a body of revolution (in order for the radiation pattern to have this same characteristic), a polygonal contour being similar to a circular contour to a first approximation in respect of the relevant radioelectric properties.

The antenna is connected to an exciter 3, for example a coaxial exciter comprising an armature 4 and a central core 5; the armature 4 is electrically connected to the conductive surface 2 and the core 5, which is at a potential different from that of the surface 2, extends above the latter in a straight central conductive rod 6 perpendicular to the conductive surface 2 and coincident with the axis 1. From the electrical point of view, this vertical rod 6 behaves as monopole excited at its base 7 by the coaxial exciter 3 and loaded by the structure at the top.

At its opposite end 8 the monopole is connected to N horizontal rods 9 (N=4 or more, for example). Each of these horizontal rods are "deduced" from its neighbours by rotation through two $2\pi/N$. At their distal end the horizontal rods 9 are each extended by a respective curvilinear rod 10 downwardly inclined at an angle to the horizontal plane 11 containing the rectilinear rods 9. This rod is in the form of a circular arc extending from one end of the horizontal rod and following the surface of a sphere centered at the end 8 of the monopole 6.

Note that the various elements 6, 9 and 10 are electrically connected directly, that is to say that there are no phase shifter, balancer, etc circuits either at the connection between the various elements or at the connection of the radiating element 6 to the excitation conductor 3. This greatly simplifies the electrical and mechanical implementation of this antenna in accordance with the invention. The only electrical component that may be required is a device 12 for matching the impedance of the excitation line 3 to the antenna. This would be disposed at the base of the central rod 6 or in the transmitter/receiver power supply device.

The theory of operation of this antenna is as follows.

The vertical rod 6 radiates like a vertically polarized monopole; the horizontal rectilinear rods 9 contribute relatively little to the radiation by virtue of their symmetry and the curvilinear rods 10 radiate a horizontal linear component essentially in phase quadrature with the vertical component produced by the vertical rod 6 and a supplemental, lower amplitude vertical component.

The combination of the various radiation patterns provides the required circular polarization radiation pattern.

The direction of the circular polarization is determined by the angular direction towards which the curvilinear rods 10 turn. To vary this polarization or to change its direction the rods 10 may be made mobile relative to the rods 9 so that the direction and the angle of inclination of the curvilinear rods to the horizontal plane 11 can be varied.

Typical values for the main dimensions are as follows:

length of the monopole 6: $\lambda/2$, this value possibly being modified to adjust the direction (site angle) of the radiation maximum;

length of rods 9: $\lambda/4$;

curvilinear length of strands 10: $7\lambda/20$;

diameter of conductive surface 2: 1.2 $\lambda$, this value possibly being modified to adjust the direction of the radiation maximum;

radius of the rod 6: 0.075 $\lambda$;

inclination of the rods 10 relative to the horizontal plane 11: 25°, this value possibly being modified to vary the polarization parameters.

An antenna implemented in accordance with the above teachings usable at frequencies up to the microwave band (10 to 20 GHz) has a gain of at least 1.5 dB for site angles between 10 and 15° relative to the horizontal with a good omnidirectional characteristic.

Various alterations and additions are naturally feasible.

In particular, the various horizontal rods 9 (which do not contribute to the radiation) may be replaced by a continuous conductive metal surface (for example a metal plate, a printed circuit plate, a conductive grid, etc) to the periphery of which the curvilinear rods 10 are joined.

There is claimed:

1. Circular polarization antenna whose radiation pattern is in the shape of a body of revolution about an axis and has a radiation minimum in the direction of said axis, comprising:

a reflective conductive surface which is essentially in the shape of a body of revolution about said axis, a rectilinear conductive rod extending axially from a first end at the level of and isolated from said conductive surface to a second end and connected at its first end to an excitation line, and a plurality of radiating arms each comprising a first rod and a depending curvilinear rod, said first rod extending in an essentially radial plane from the second end of said conductive rod, said first rod being electrically connected at its proximal end directly to said conductive rod and connected at its distal end to said depending curvilinear rod essentially lying on the surface of a sphere centered at said second end and the chord direction of each said curvilinear rod making an angle with said radial plane.

2. Circular polarization antenna as defined in claim 1, wherein said plurality of radiating arms comprises at least four radiating arms.

3. Circular polarization antenna as defined in claim 1, wherein said rectilinear conductive rod is connected directly to said plurality of radiating arms.

4. Circular polarization antenna as defined in claim 1, wherein said rectilinear conductive rod is connected directly to the excitation line.

5. Circular polarization antenna as defined in claim 1, further comprising means, coupled between said rectilinear conductive rod and the excitation line, for matching the impedance of the excitation line to the antenna.

6. Circular polarization antenna as defined in claim 1, wherein said reflective conductive surface electrically functions as a ground plane.

7. Circular polarization antenna as defined in claim 1, wherein said reflective conductive surface is one of a continuous surface or a mesh surface.

8. Circular polarization antenna as defined in claim 1, wherein the placement of said curvilinear rods of each of said plurality of radiating arms relative to said axis and said radial plane is variable so as to determine the direction of the circular polarization.

9. Circular polarization antenna as defined in claim 1, wherein said radiating arms are homogeneous, rigid rods shaped to form said first rod and said depending curvilinear rod.

* * * * *